US006029494A

United States Patent [19]

Wu

[11] Patent Number: 6,029,494

[45] Date of Patent: Feb. 29, 2000

[54] SPRING PRODUCING DEVICE

[76] Inventor: David Wu, No.21, Alley 9, Lane 27, Sec.5, Min Shen E. Rd., Taipei, Taiwan

[21] Appl. No.: 09/187,683

[22] Filed: Nov. 5, 1998

[51] Int. Cl.[7] ..... B21D 7/024

[52] U.S. Cl. ..... 72/387; 72/219

[58] Field of Search ..... 72/387, 212, 217, 72/219

[56] References Cited

U.S. PATENT DOCUMENTS 3,803,893 4/1974 Peddinghaus et al. ..... 72/217
3,894,422 7/1975 Peddinghaus ..... 72/217
4,571,974 2/1986 Pollhammer et al. ..... 72/387
5,025,651 6/1991 Del Fabro et al. ..... 72/217

*Primary Examiner*—David Jones
*Attorney, Agent, or Firm*—Rosenberg, Klein & Lee

[57] ABSTRACT

A spring producing device comprises a main body, a first axle, a second axle, a spindle and a motor. The first axle is arranged on the main body and has a plurality of bumps, the spindle has at least one bump, and the motor is connected to the second axle such that the motor can drive the spindle through the second axle. The rotation angle of the spindle can be precisely controlled and the yield is enhanced with little manual labor.

4 Claims, 9 Drawing Sheets

SPRING PRODUCING DEVICE

FIELD OF THE INVENTION

The present invention relates to a spring producing device, more particularly to a spring producing device driven by motor and used to bend a line-shaped material into spring.

BACKGROUND OF THE INVENTION

The spring producing device is generally used to bend a line-shaped material into spiral component such as spring. As shown in FIG. 1, the convectional sprig producing device comprises a body 10*a*, an axle 11*a,* a spindle 12*a* and a grip 13*a* The axle 11*a* is fixed on the body 10*a* and the spindle 12*a* is rotatably arranged around the axle 11*a*. Moreover, pins 14*a* and bump 15*a* are provided on the axle 11*a* and the spindle 12*a,* respectively. The grip 13*a* is connected to the spindle 12*a* by which the user can rotate the spindle 12*a*.

The line-shaped material (hereinafter shorted as line) 16*a* is fed by a line feeder (not shown) and clamped between die pins 14*a* on axle 11*a* and extrudue a specific length. Then the user rotates the spindle 12*a* through the grip 13*a* to a specific angle such that the bump 15*a* touches the line 16*a* and bend the line 16*a* to desired shape.

However, the abovementioned spring producing device is operated manually such that the line 16*a* is hard to position precisely and the rotation of spindle is laboring. Therefore, the yield of the spring produced is reduced and the manual cost is high.

It is the object of the invention to provide a spring producing device which is equipped with electric motor to rotate the spindle and bend the line through the bump on the spindle. The rotation of the spindle is adjustable according to the input amount of the line. Therefore, the rotation angle of the spindle can be precisely controlled and the yield is enhanced with little manual labor.

The various objects and advantages of the present invention will be more readily understood from the following detailed description when read in conjunction with the appended drawing, in which:

DETAIL DESCRIPTION OF PREFERRED EMBODIMENT

Figure 1:
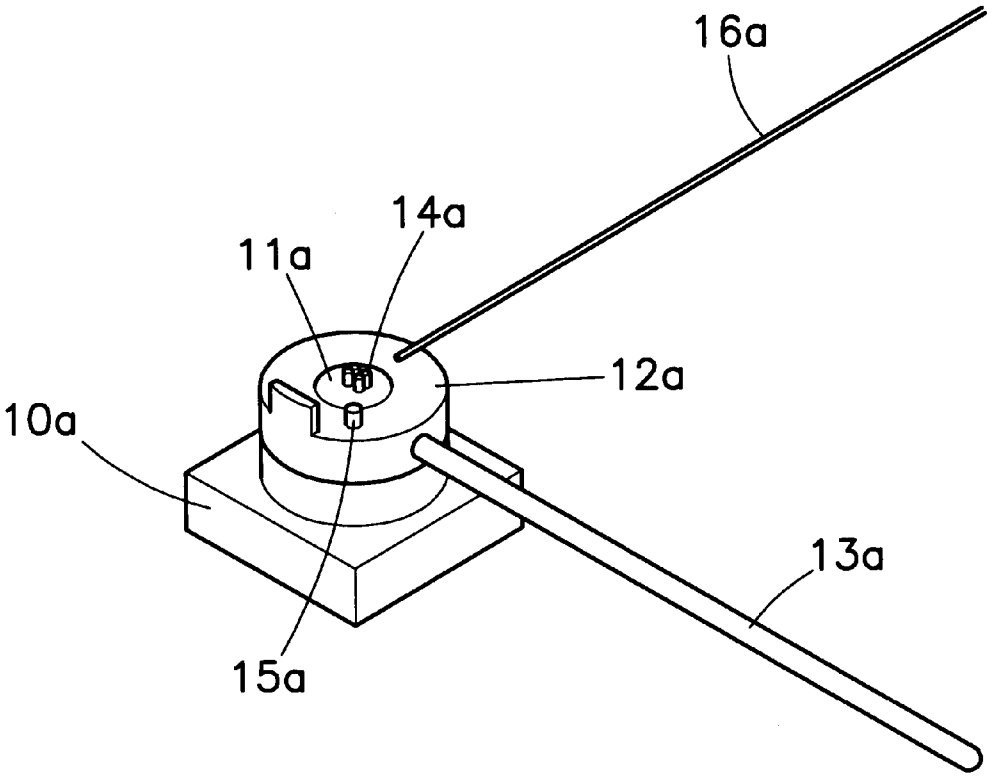
FIG. 1 PRIOR ART
FIG. 1 is the perspective view of a conventional spring producing device.
Figure 2:
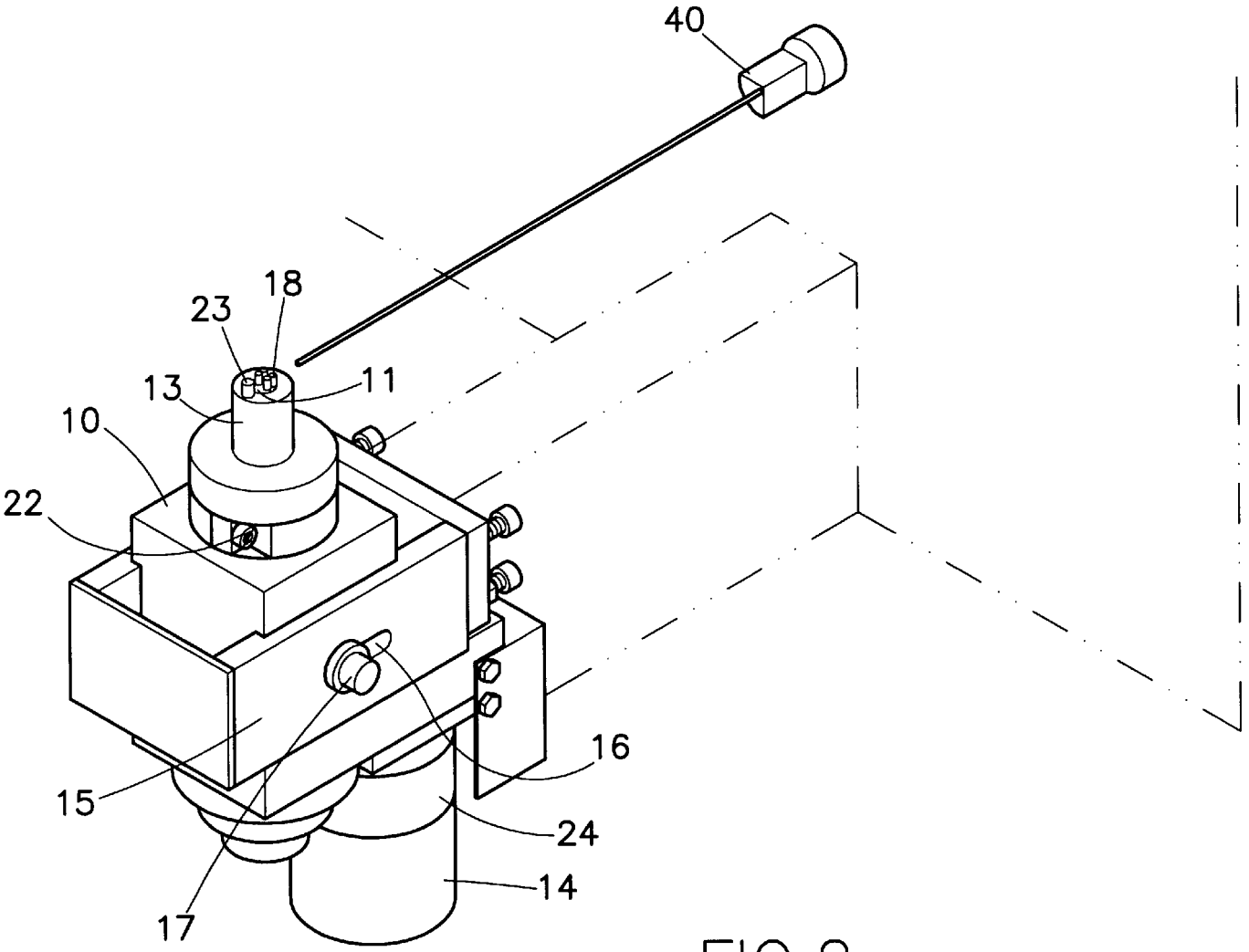
FIG. 2 is the perspective view of a spring producing device according to an embodiment of the present invention.
Figure 3:
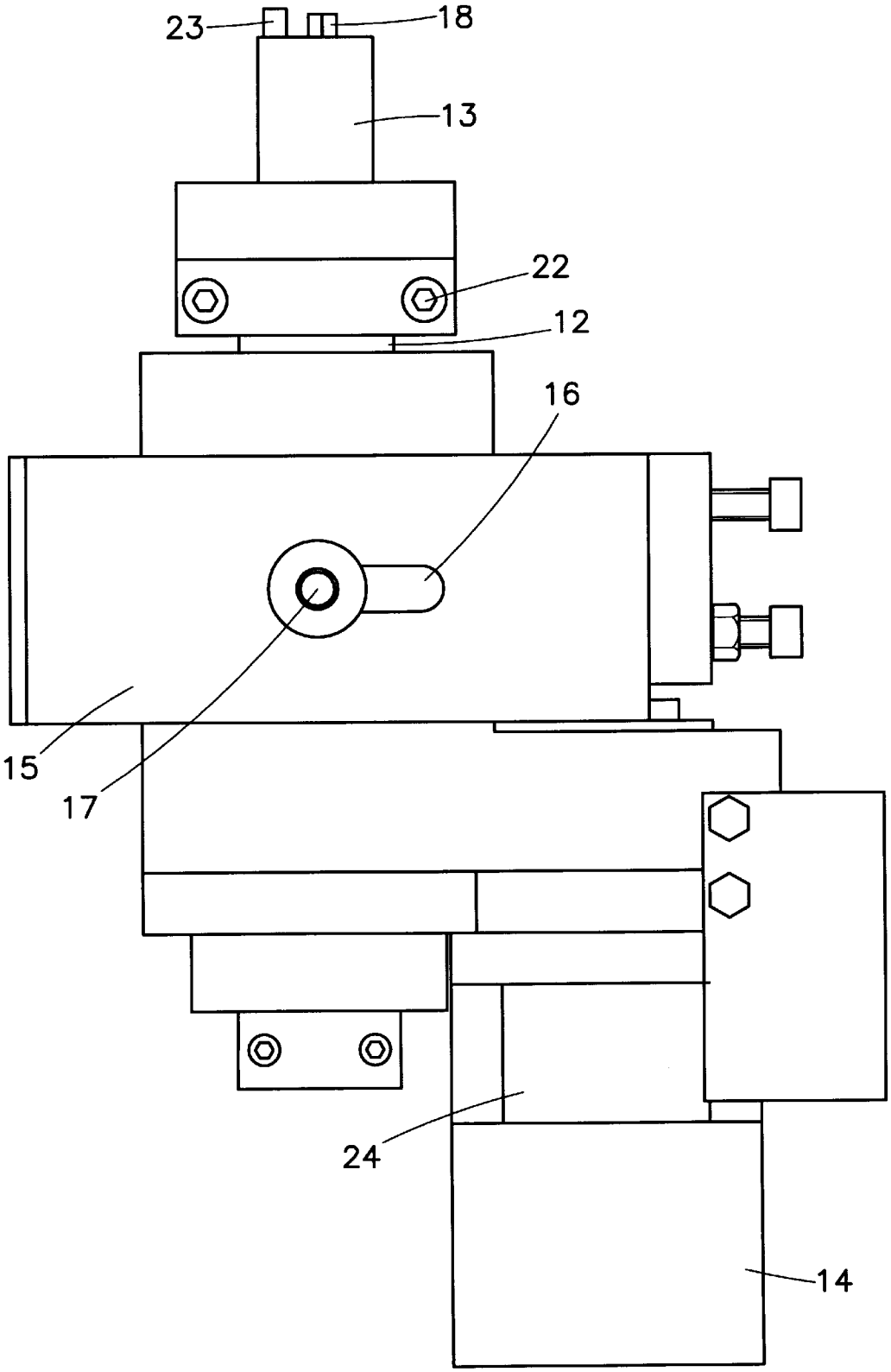
FIG. 3 is the front view of a spring producing device according to an embodiment of the present invention.
Figure 4:
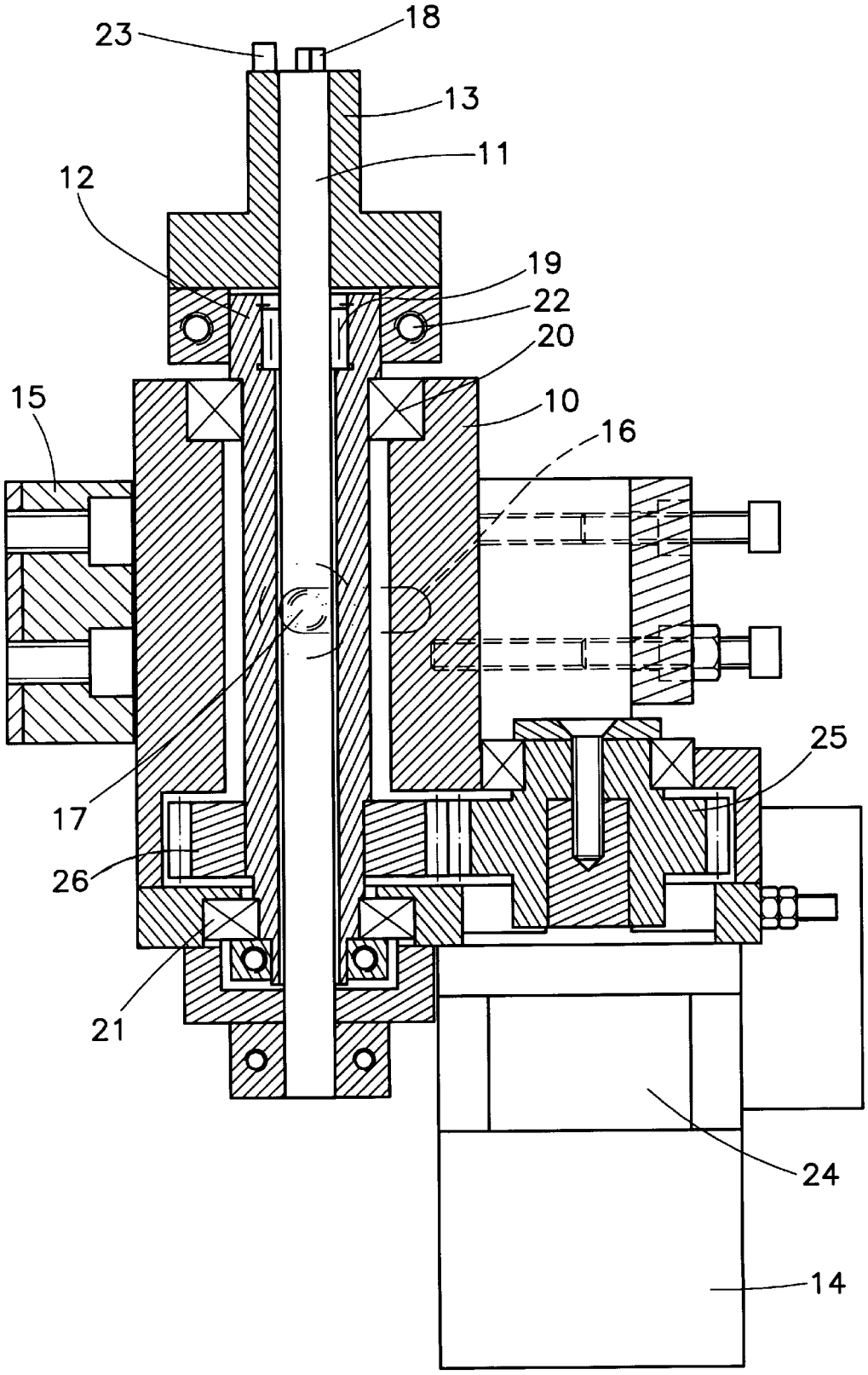
FIG. 4 is the side view of a spring producing device according to an embodiment of the present invention.

As shown in FIGS. 2 to 4, the inventive spring producing device comprises a main body 10, a first axle 11, a second axle 12, a spindle 13 and a motor 14, wherein the main body is firmly arranged. The body 10 is slidably arranged in a stage 15. Both sides of the stage 15 have horizontal slot 16 and screw 17 is engaged into the body 10 through the slot 16. The body 10 is allowed to slide horizontally on stage 15 when the screw 17 is unscrewed. The feeding pitch of the line feeder 40 can be adjusted and then the screw 17 is screwed.

The first axle 11 is fixed and erects on the body 10. The fist axle 11 has a plurality of pins 18. The second axle 12 is of hollowed-cylinder shape and rotatably encircles the first axle 11. A bearing is provided between the second axle 12 and the first axle 11, and bearings 20 and 21 are provided between the second axle 12 and the body 10 such that the second axle 12 can rotate smoothly. The spindle 13 is arranged outside the first axle 11, the spindle 13 is locked to the top of the second axle by a screw 22 and rotates with the second axle. At least one bump 23 is provided on the top of the spindle 13.

The motor 14 is a servomotor arranged below the body 10 and connected to a driving wheel 25 through a decelerating means 24. The driving wheel 25 is engaged with a driving wheel 26 arranged on the second axle. Therefore, the motor 14 can drive the second axle 12 and the spindle 13 through the driving wheel 25 and the driving wheel 26.

Figure 5:
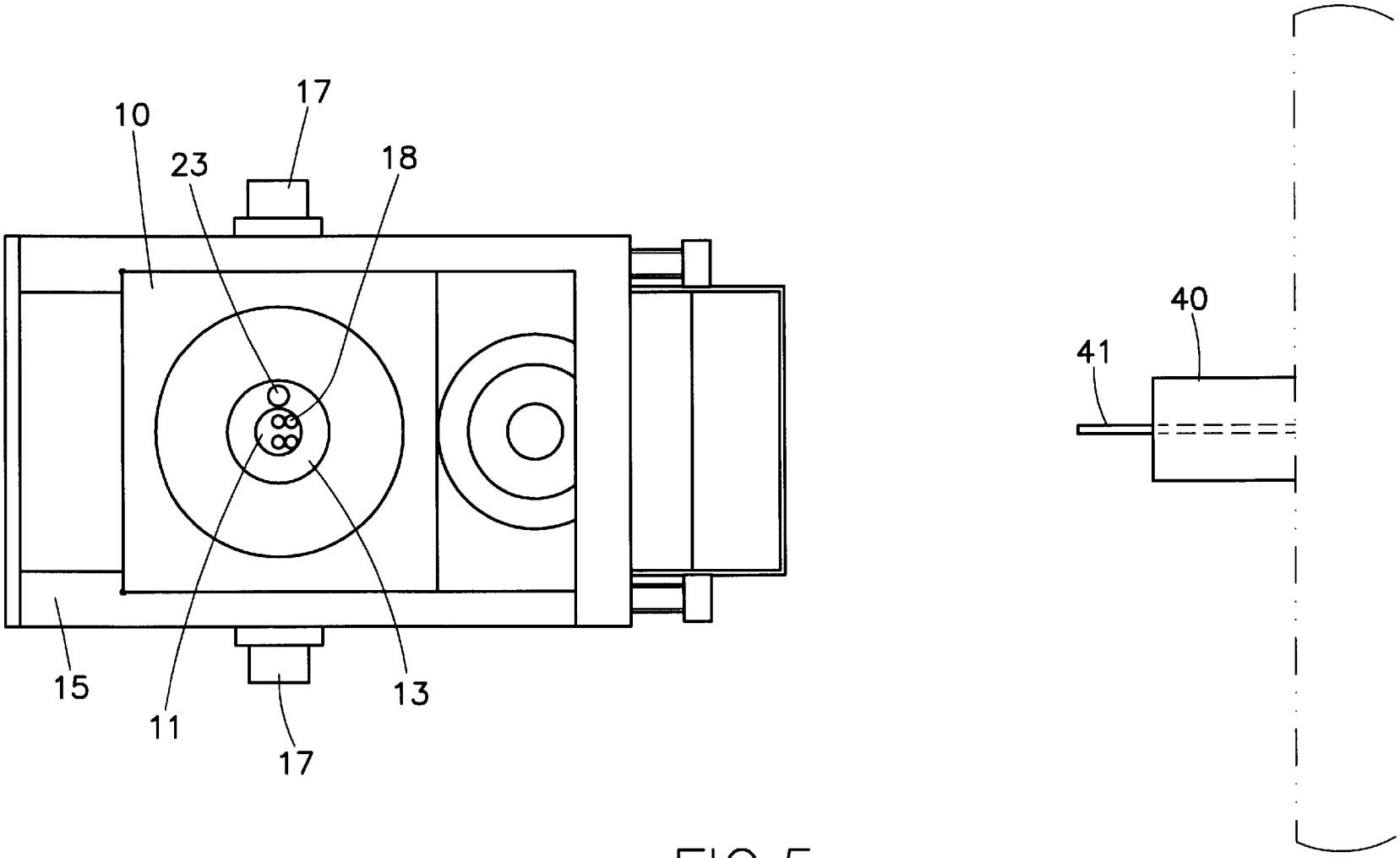
FIG. 5 is a schematic view showing the operation of a spring producing device according to an embodiment of the present invention.
Figure 6:
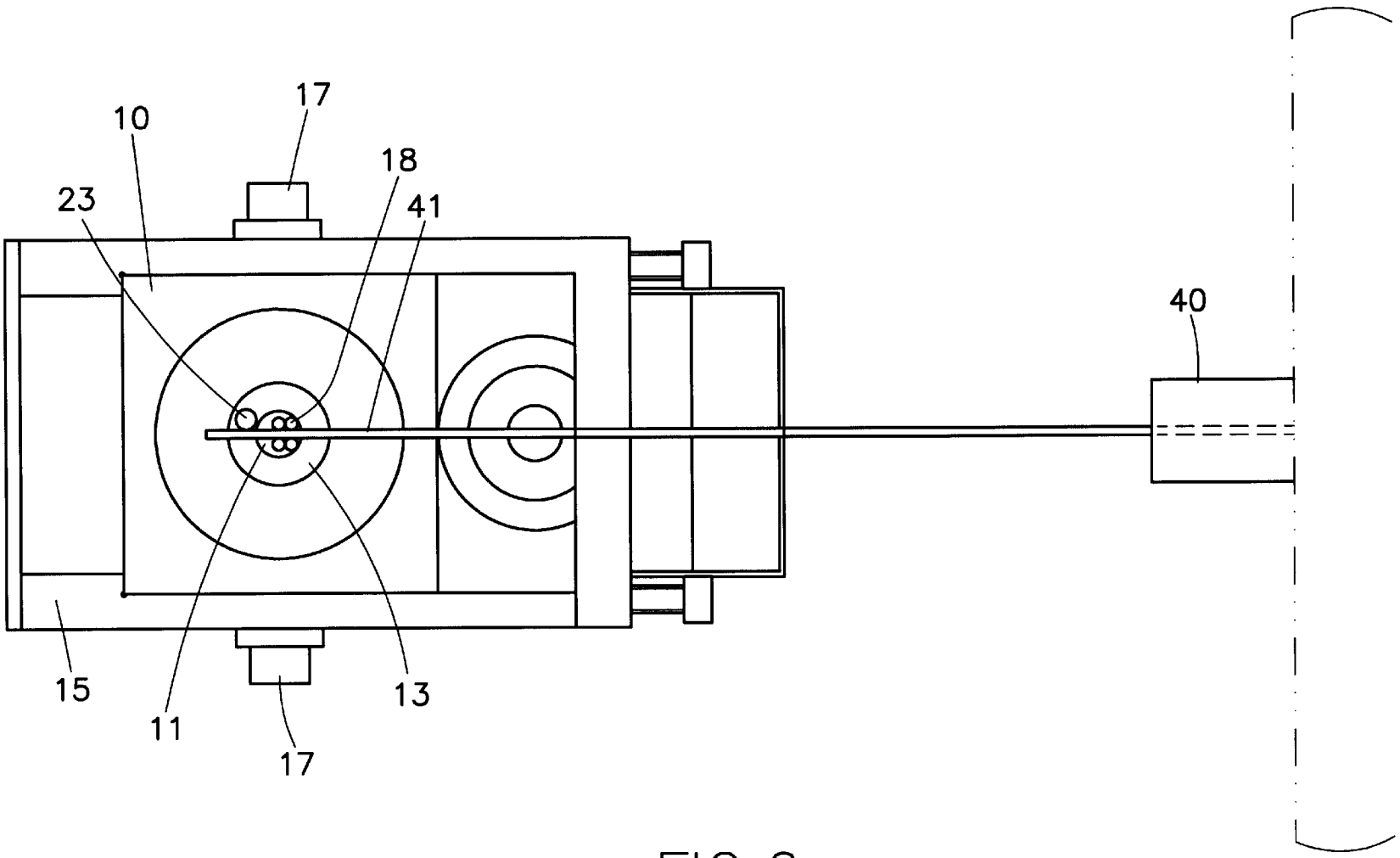
FIG. 6 is another schematic view showing the operation of a spring producing device according to an embodiment of the present invention.
Figure 7:
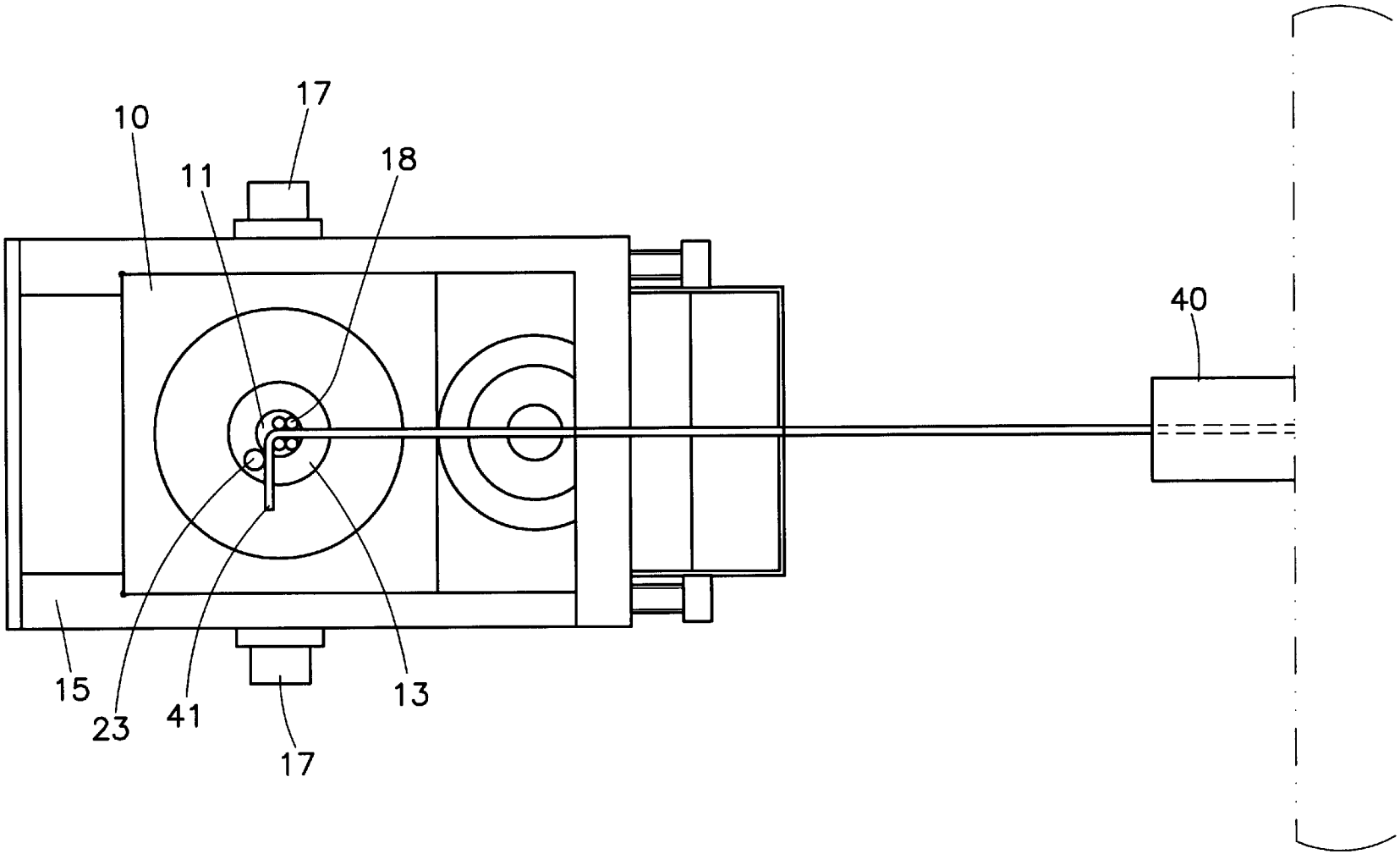
FIG. 7 is still another schematic view showing the operation of a spring producing device according to an embodiment of the present invention.

The inventive device is used to bend the line to form spring. As shown in FIG. 5, the line 41 can be fed through conventional line feeder and provided from an output pipe 40. As shown in FIG. 6, the line 41 is fed to a position between the pins 18 suitable that the line 41 can be clamped by the pins 18, and the line 41 extrudes a suitable length out of the pins 18. As shown in FIG. 7, through the driving of the motor 14, the spindle 13 is rotated a specific angle and the bump 23 is driven to touch the line 41. Therefore, the line 41 can be bent to a desired shape. After the line 41 is formed into desired shape, the spring can be cut to preferred length by a cutter (not shown).

The present invention uses the motor 14 to drive the second axle 12 and the spindle 13, and rotate the bump 23 on top of the spindle 13 to bend the line 41 to desired shape. Moreover, the motor 14 can be equipped with suitable program and control circuit such that the spindle 13 can be more precisely rotated with respect to the feeding condition of the line. Therefore, the processing is ore precise and the yield is enhanced.

Figure 8:
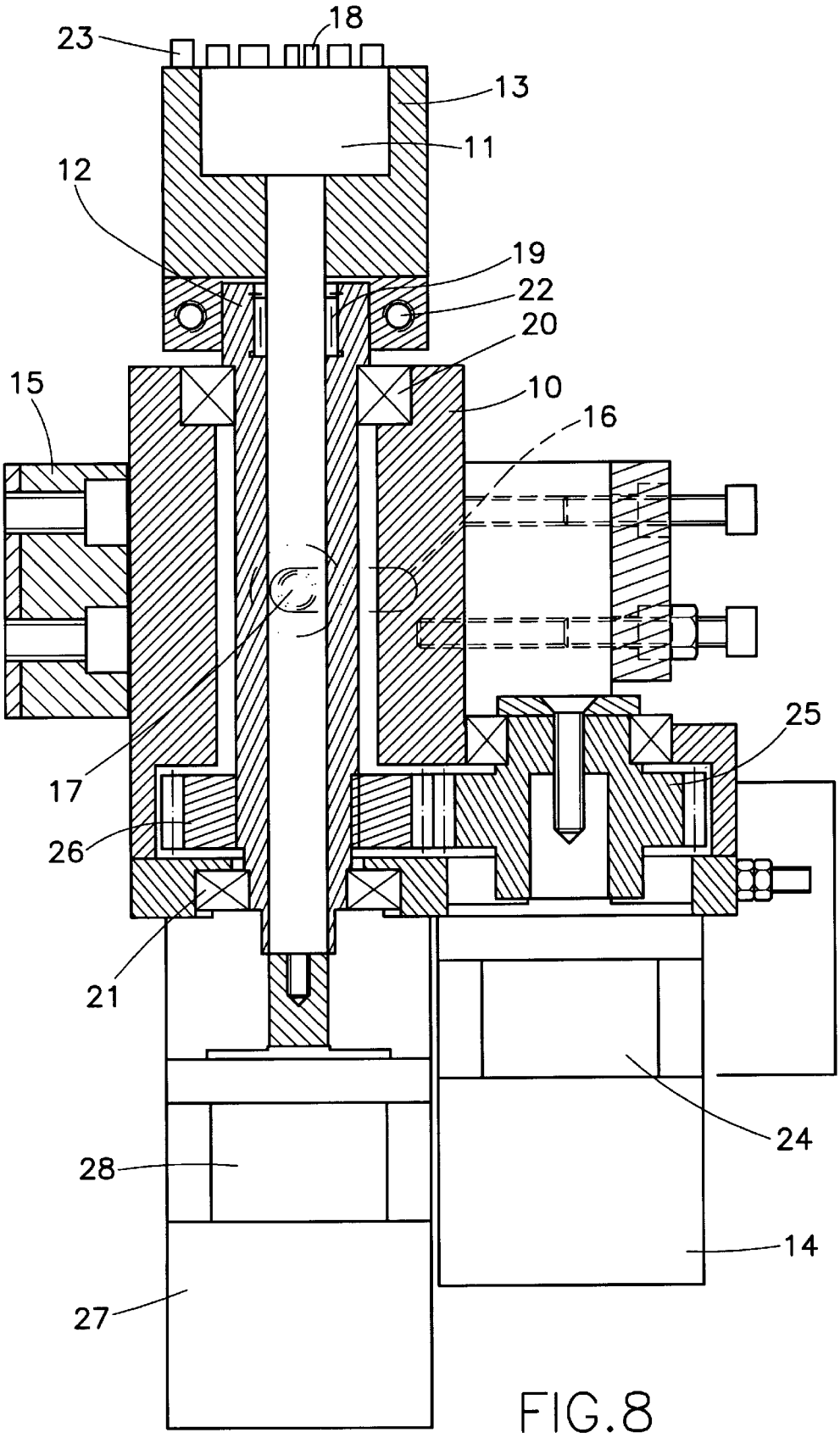
FIG. 8 is the side view of a spring producing device according to another embodiment of the present invention.
Figure 9:
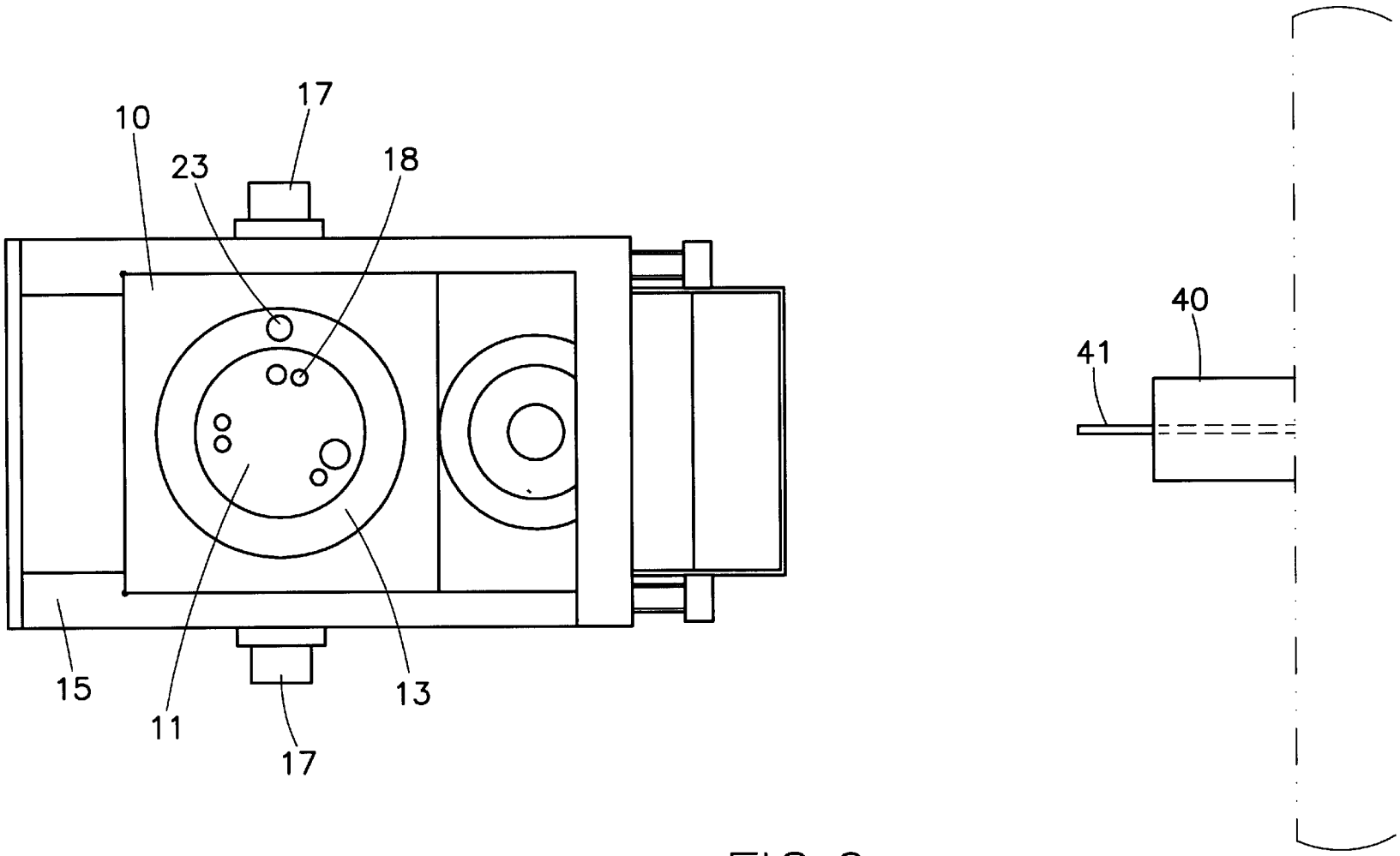
FIG. 9 is the side view of a spring producing device according to another embodiment of the present invention.

As shown in FIGS. 8 and 9, the first axle 11 can also be rotatable and equipped with a motor 27 thereunder. The meter 27 is arranged under the body 10 and connected to the bottom of the first axle 11 through suitable decelerating means. The rotation of the motor 27 can also drive the first axle 11, thus providing more choices of curvature radius. By choosing different pins 18 to clamp the line 41 and bend the line 41 through the bump 23, the bending shape of the line is more versatile.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A spring producing machine, comprising:

a stage having a pair of slots respectively formed in opposing sides thereof;

a main body secured slidably in a horizontal direction to said stage by a screw passing through said main body and said slots of said stage;

a first axle arranged on said main body and having a plurality of pin-shaped bumps extending from an upper end thereof;

a second axle having a hollow cylindrical shape and rotatably housing said first axle;

a spindle arranged outside said first axle and locked to an upper end of said second axle, said spindle having at least one bump extending from an upper end of said spindle; and, a motor linked with said second axle for rotatably driving said second axle and said spindle, wherein material is fed through and clamped by said plurality of pin-shaped bumps on said first axle and said motor drives said spindle such that the material is bent by said bump on said spindle to a predetermined shape.

2. The spring producing machine as recited in claim 1, wherein said first axle is fixedly arranged on said main body.

3. The spring producing machine as recited in claim 1, wherein said first axle is rotatably arranged on said main body and driven by a second motor.

4. The spring producing machine as recited in claim 1, further comprising a decelerating means and a wheel through which said motor is linked to said second axle.

* * * * *